US011022365B2

(12) United States Patent
Heo

(10) Patent No.: US 11,022,365 B2
(45) Date of Patent: Jun. 1, 2021

(54) WIRE HARNESS FIXING DEVICE AND REFRIGERATOR INCLUDING SAME

(71) Applicant: Daewoo Electronics Co., Ltd., Gwangju (KR)

(72) Inventor: Ji-Hyun Heo, Incheon (KR)

(73) Assignee: DAEWOO ELECTRONICS CO., LTD., Gwangju (KR)

( * ) Notice: Subject to any disclaimer, the term of this patent is extended or adjusted under 35 U.S.C. 154(b) by 244 days.

(21) Appl. No.: 16/198,554

(22) Filed: Nov. 21, 2018

(65) Prior Publication Data

US 2019/0368803 A1 Dec. 5, 2019

(30) Foreign Application Priority Data

May 29, 2018 (KR) ..... 10-2018-0060975

(51) Int. Cl.
*A47B 96/04* (2006.01)
*F25D 23/02* (2006.01)

(52) U.S. Cl.
CPC ..... *F25D 23/028* (2013.01); *F25D 2323/021* (2013.01); *F25D 2400/40* (2013.01)

(58) Field of Classification Search
CPC ..... F25D 23/028; F25D 2323/021; F25D 2400/40; H02G 3/22
See application file for complete search history.

(56) References Cited

U.S. PATENT DOCUMENTS 4,805,293 A * 2/1989 Buchser ..... F25D 23/064 264/46.6
5,000,010 A * 3/1991 Powell ..... F25D 21/04 312/401
5,104,333 A * 4/1992 Hatagishi ..... H01R 13/62922 439/342
5,238,299 A * 8/1993 McKinney ..... F25D 23/065 174/153 G
5,252,089 A * 10/1993 Hatagishi ..... B60R 16/02 439/310
5,263,509 A * 11/1993 Cherry ..... F25D 23/028 137/343
2006/0223351 A1* 10/2006 Kim ..... F25D 23/064 439/157
2011/0234074 A1* 9/2011 Dolinsek ..... H02G 3/22 312/404
2013/0328471 A1* 12/2013 Gore ..... F25D 23/00 312/401
2017/0176092 A1* 6/2017 Naik ..... F25D 23/061

* cited by examiner

*Primary Examiner* — Matthew W Ing

(57) ABSTRACT

The present invention relates to a refrigerator appliance including a wire harness fixing device and, more particularly, to a fixing device for fixing a wire harness crossing a space between an inner panel and an outer panel of a door, and where the wire harness is configured for electrical connection with a heater inside a partition unit. Embodiments also include a refrigerator appliance including the wire harness fixing device. The wire harness fixing device having a body part configured to have a hollow portion formed therein, thereby allowing a wire harness to be inserted therein, and an opening portion formed to be open partially at one surface thereof. The wire harness also having a fixing part, a cover part and a coupling part.

16 Claims, 7 Drawing Sheets

WIRE HARNESS FIXING DEVICE AND REFRIGERATOR INCLUDING SAME

CROSS REFERENCE TO RELATED APPLICATION

The present application claims priority to Korean Patent Application No. 10-2018-0060975, filed May 29, 2018, the entire contents of which is incorporated herein for all purposes by this reference.

BACKGROUND OF THE INVENTION

Field of the Invention

An embodiment of the present invention relates to a refrigerator appliance including a wire harness fixing device and, more particularly, relates to a fixing device for affixing a wire harness that traverses a space between panels of a refrigerator door to make electrical connection with a heater unit of the refrigerator and also relates to a refrigerator appliance including the fixing device.

Description of the Related Art

Generally, a refrigerator appliance has refrigeration cycle components such as a compressor, a condenser, and the like and generates cold air through actions of the refrigeration cycle to maintain the freshness of food stored therein over time.

Hereinafter, a "French door" style refrigerator will be described in detail.

In the typical French door style refrigerator, a storage chamber is divided into left and right sides, and a first door for opening and closing a refrigeration compartment is disposed on a left side, and a second door for opening and closing a freezer compartment is disposed on a right side. Further, a rotatable partition unit is included to prevent cold air from leaking through a space defined between the first and second doors.

In addition, since condensation occurs on an outer surface of the rotatable partition unit due to temperature differences between the inside and outside of the refrigerator, a heater unit is typically disposed inside the partition unit to remove the condensation through evaporation.

Accordingly, a wire harness is typically used to operate and power the heater, and a fixing device for affixing the wire harness is disposed in an inner space between an inner panel and an outer panel of the first door. The inside of the corresponding space is typically filled with an insulating foam material such as urethane, for instance.

Generally, a conventional fixing device has one end that is in contact with an inner surface of an outer panel of the first door. When the fixing device remains stationary over time, this causes unwanted curvature of the outside of the refrigerator, which lowers the aesthetic quality of the appliance.

In addition, in order to prevent this unwanted curvature, a nonwoven fabric is often applied between the fixing device and the first door. However, since the nonwoven fabric is relatively expensive, this solution adds unwanted expense to the appliance and the added installation of the fabric increases the overall manufacturing time and complexity of the appliance. This eventually causes an increase in overall product cost of the appliance. It would be advantageous to eliminate any need for the fabric installation.

SUMMARY OF THE INVENTION

Therefore, in order to prevent such problems as described above, embodiments of the present invention are directed toward a wire harness fixing device, and a refrigerator appliance including the fixing device, wherein the unwanted curvature is avoided because the lower end portion of the wire harness fixing device does not contact any opening and closing unit (e.g., door) of the refrigerator. An embodiment of the present invention is directed to a wire harness fixing device having an upper plate and a protection plate for preventing an insulating foam material from filling into the fixing device during manufacturing, and embodiments are also directed toward a refrigerator appliance including such a fixing device.

In addition, it is an object of the present invention to provide a wire harness fixing device capable of easily guiding and then affixing a wire harness inserted inward through a first guide groove thereof and a second guide groove. The second guide groove having a smaller radius than the first guide groove. Embodiments also include a refrigerator appliance including such a fixing device.

In addition, it is an object of the present invention to provide a wire harness fixing device forming a bending part in a "U-shaped cross section" inside an opening and closing unit, e.g., a door of the refrigerator, thereby allowing an insertion portion inserted into an inner space of the bending part to be easily coupled with the door, and a refrigerator appliance including such a fixing device.

In addition, embodiments of the present invention are characterized in that the distance from a height of a second locking hole to a lowermost end of the fixing device is shorter than the distance from a first locking hole to an inner surface of an outer panel facing an inner panel of an opening and closing unit at one side. Accordingly, it is an object of the present invention to provide a wire harness fixing device that prevents a lower end portion thereof from contacting the inner surface of the outer panel of a refrigerator, thereby advantageously preventing curvature from occurring on an outer surface of the door located at one side, and a refrigerator appliance including such a fixing device.

In addition, it is another object of the present invention to provide a wire harness fixing device that does not require application of a high-priced nonwoven fabric used between a fixing device and the door to prevent curvature, and a refrigerator appliance including such a fixing device.

More specifically, embodiments of the present invention are described in summary below.

A wire harness fixing device according to an embodiment of the present invention includes: a body part configured with a hollow portion disposed therein, thereby allowing a wire harness to be inserted therein and an opening portion being partially open at one surface thereof; a fixing part coupled to a lower portion of the body part and configured to guide insertion of the wire harness; a cover part coupled with a lower end surface of one side of the body part, thereby allowing an open lower portion of a fixing device to be opened or closed; and a coupling part configured to allow the fixing device to be affixed to one side of a refrigerator.

The fixing part formed on the wire harness fixing device according to another embodiment of the present invention includes: a first guide groove recessed upwardly at a side coupled with the front surface of the body part, thereby guiding insertion of the wire harness; an upper plate extending in opposite lateral directions from an end of the first guide groove; and a protection plate extending downward from an end of the upper plate, and preventing an insulating foam material from filling into the fixing device during manufacturing.

The cover part formed on the wire harness fixing device according to still another embodiment of the present invention includes: a second guide groove recessed upwardly when the cover part is fully opened, thereby forming a cylindrical guide hole together with the first guide groove; a coupling portion disposed at each of spaced opposite ends of the cover part, thereby allowing the cover part to remain closed by being coupled with one side of the fixing part; and a connection part formed in a groove along a longitudinal direction of a side of the cover part, wherein the side is coupled with the body part, thereby enabling the cover part to rotate.

The coupling portion disposed on the wire harness fixing device according to still another embodiment of the present invention is shaped in accordance with a hook.

The second guide groove formed on the wire harness fixing device according to still another embodiment of the present invention has a radius smaller than a radius of the first guide groove.

A refrigerator appliance including a wire harness fixing device according to an embodiment of the present invention includes: the wire harness fixing device according to any one of the above-described wire harness fixing device embodiments; a main body unit having a storage chamber therein and having a front surface thereof being open; a pair of left and right opening and closing units (e.g., doors) for selectively opening and closing the front surface of the main body unit in accordance with a rotational movement thereof; and a partition unit rotatably coupled with one of the doors and located at one side to prevent cold air from leaking along a space formed between the doors.

The door located at the one side disposed on a refrigerator including a wire harness fixing device according to another embodiment of the present invention includes: a bending part defining an end of an inner side wall to which inner and outer panels are connected and cause to bend, wherein the bending part includes: a first bent portion where a side adjacent to the partition unit of the inner side wall is bent; and a second bent portion bent towards an outer panel side from an end of the first bent portion and including a first locking hole, thereby being formed in a "U-shaped cross section."

The coupling part formed on a refrigerator including a wire harness fixing device according to still another embodiment of the present invention includes: an insertion portion extending upwardly and having an upper portion inserted into an inner space of the bending part; and a second locking hole formed through an upper side of the insertion portion and allowing a locking means to be inserted therein and aligned with the first locking hole.

The second locking hole formed on a refrigerator including a wire harness fixing device according to still another embodiment of the present invention is formed such that the distance from a height of the second locking hole to a lowermost end of the fixing device is shorter than the distance from the first locking hole to an inner surface of an outer panel facing an inner panel of the opening and closing unit at the one side.

The coupling part formed on a refrigerator including a wire harness fixing device according to still another embodiment of the present invention further includes a positioning portion formed to extend upwardly on a side adjacent to the insertion portion and oriented at an acute angle with the insertion portion.

The positioning portion formed on a refrigerator including a wire harness fixing device according to still another embodiment of the present invention is formed with an upper surface shaped complementary to a lower surface of the second bent portion, thereby preventing the wire harness fixing device from shaking by allowing the upper surface of the positioning portion to contact the lower surface of the second bent portion when the first and second locking holes are aligned with each other.

The body part formed on a refrigerator appliance including a wire harness fixing device according to still another embodiment of the present invention is formed in a general hexahedral shape with a bottom surface being partially or wholly open, and is inclined wherein a distance between opposite spaced sides of the body part decreases or tapers along an upward direction.

A refrigerator including a wire harness fixing device according to still another embodiment of the present invention includes: a fixing device for fixing a wire harness that reaches a partition unit traversing through an inner space between inner and outer panels of a door located at one side; a main body unit provided with a storage chamber therein and having an open front surface thereof, a pair of left and right doors for selectively opening and closing the front surface of the main body unit in accordance with a rotational movement thereof, and a partition unit rotatably coupled with the door located at the one side to prevent cold air from leaking along a space formed between the doors, wherein the door located at the one side among the left and right doors includes a bending part formed with a first locking hole to allow locking means to be inserted in one side where an end of an inner side wall (to which inner and outer panels are connected) is forced to bend in a "U-shaped cross section."

The fixing device formed on a refrigerator including a wire harness fixing device according to still another embodiment of the present invention includes a coupling part, wherein the coupling part includes: an insertion portion extending upwardly and having an upper portion inserted into an inner space of the bending part; and a second locking hole formed through an upper side of the insertion portion and allowing a locking means to be inserted therein when aligned with the first locking hole.

The fixing device formed on a refrigerator including a wire harness fixing device according to still another embodiment of the present invention has a length insufficient to contact an adjacent inner surface of the door located at the one side, when the first and second locking holes are aligned with each other and the locking means is fixed to the door located at the one side through insertion of the locking means.

The above described embodiments of the present invention have following advantages.

The upper plate and the protection plate of the present invention prevent the insulating foam material from filling into the fixing device.

Further, embodiments provide easy guiding and rigid fixation of the wire harness as inserted inward through the first guide groove and the second guide groove wherein the second guide groove has a smaller radius than the first guide groove.

Further, embodiments of the present invention form a bending part in a "U-shaped cross section" inside the door, thereby allowing the insertion portion inserted into the inner space of the bending part to be easily coupled with the door.

Further, an embodiment of the present invention is characterized in that the distance from a height of the second locking hole to a lowermost end of the fixing device is shorter than the distance from the first locking hole to an inner surface of an outer panel facing an inner panel of an opening and closing unit at one side. Accordingly, an embodiment of the present invention has an advantage of preventing a lower end portion of the device from contacting the inner surface of the outer panel of a refrigerator, thereby advantageously preventing curvature from occurring on an outer surface of the door located at the one side.

In addition, embodiments of the present invention are advantageous in that they do not require application of a high-priced nonwoven fabric between the fixing device and the opening and closing unit to prevent curvature.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
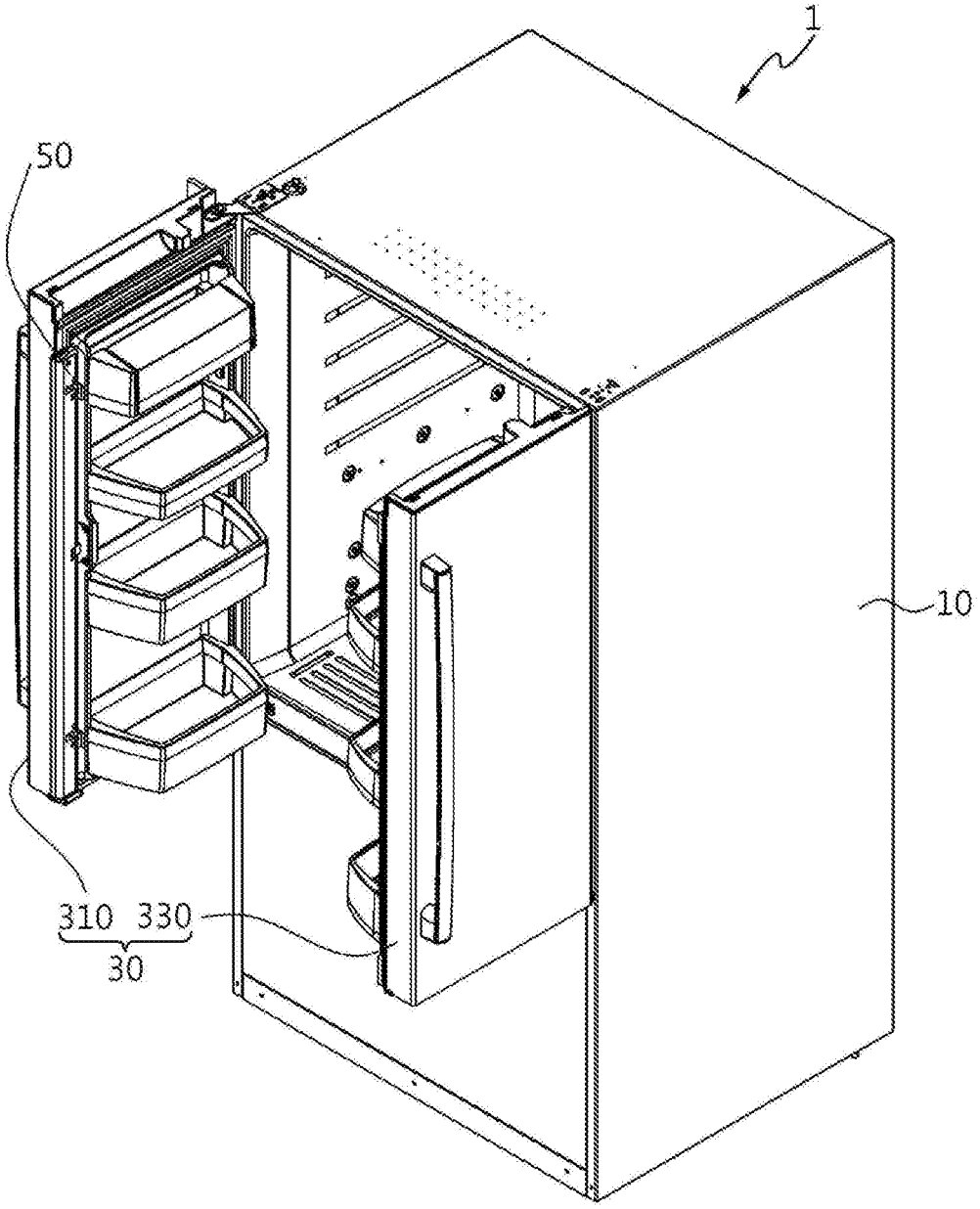
FIG. 1 is a perspective view of a refrigerator appliance including a wire harness fixing device according to an embodiment of the present invention.

Hereinafter, preferred embodiments of the present invention will be described in detail with reference to accompanying drawings in order to enable a person skilled in the art to easily carry out a technical idea of the present invention. First, in adding reference numerals to constituent elements of the drawings, it is to be noted that the same constituent elements are denoted by the same reference numerals even though they are shown in different drawings. In the following description of the present invention, detailed descriptions of known functions and configurations incorporated herein may be omitted when they may obscure aspects of the present invention.

In addition, terms such as first, second, etc. may be used to describe various items such as various elements and/or configurations, but the items are not limited thereby. For example, it should be noted that a second element is not necessarily based on a first element, but is merely used for convenience, and that each element is independent.

Figure 2:
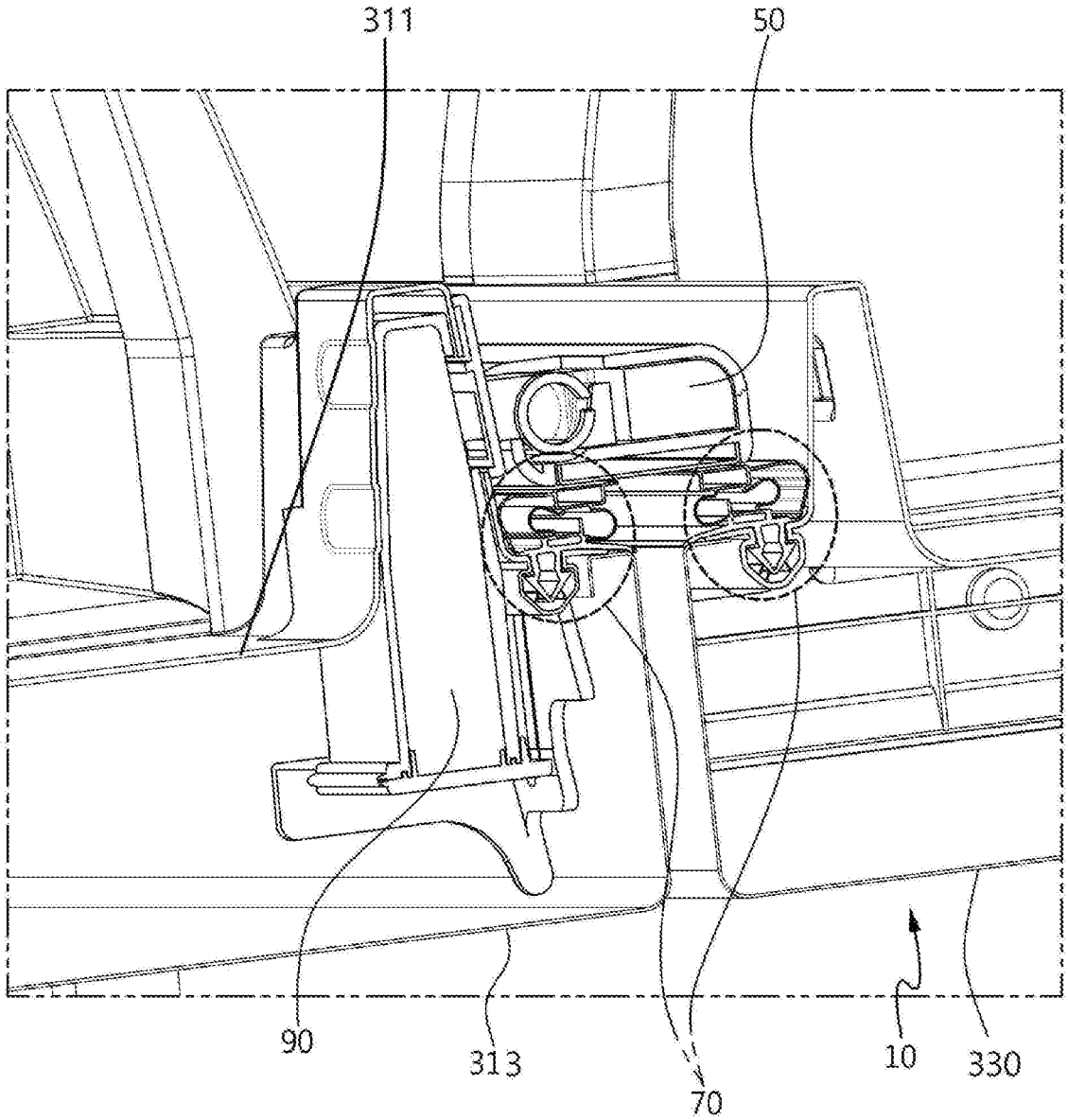
FIGS. 2 and 3 are cross sectional views illustrating a configuration where a wire harness fixing device is coupled with an opening and closing unit at one side of a refrigerator appliance in accordance with an embodiment of the present invention.
Figure 3:
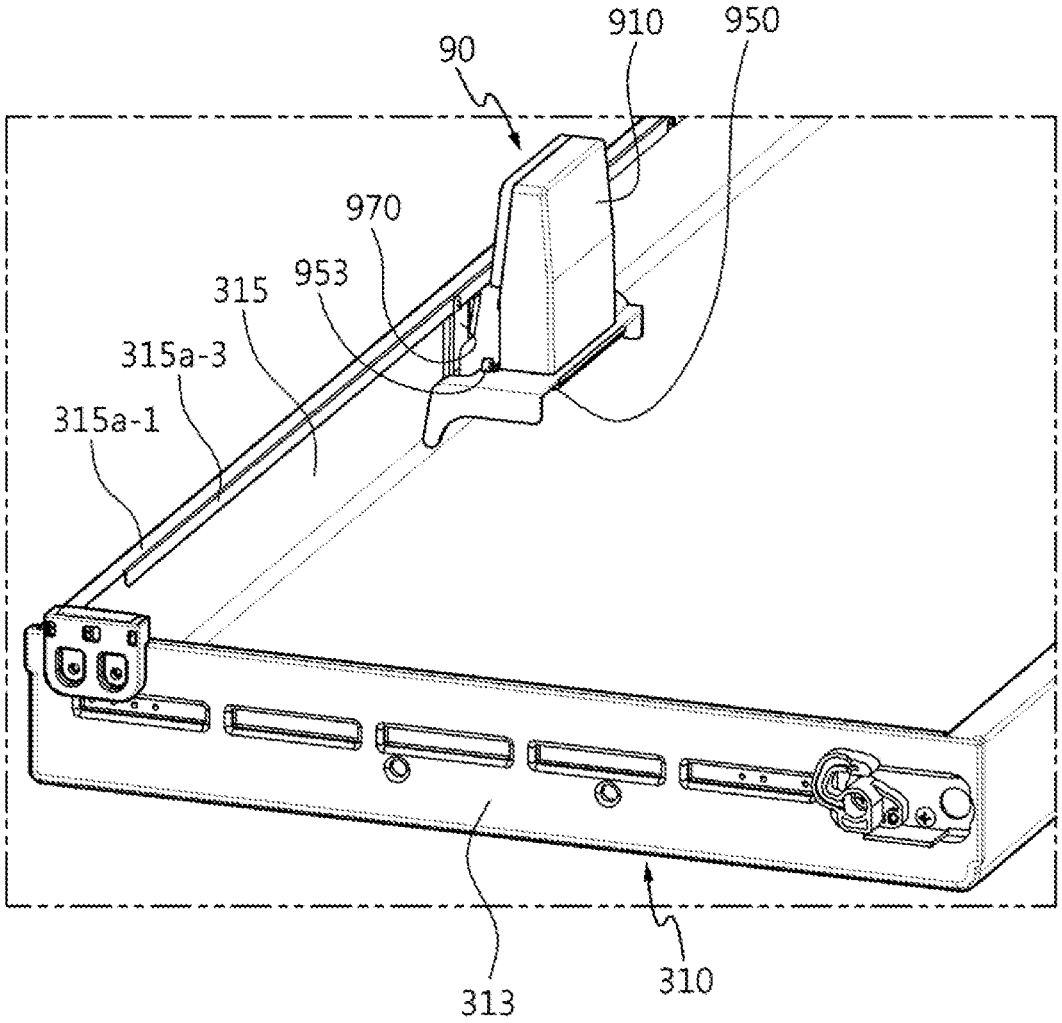
Figure 4:
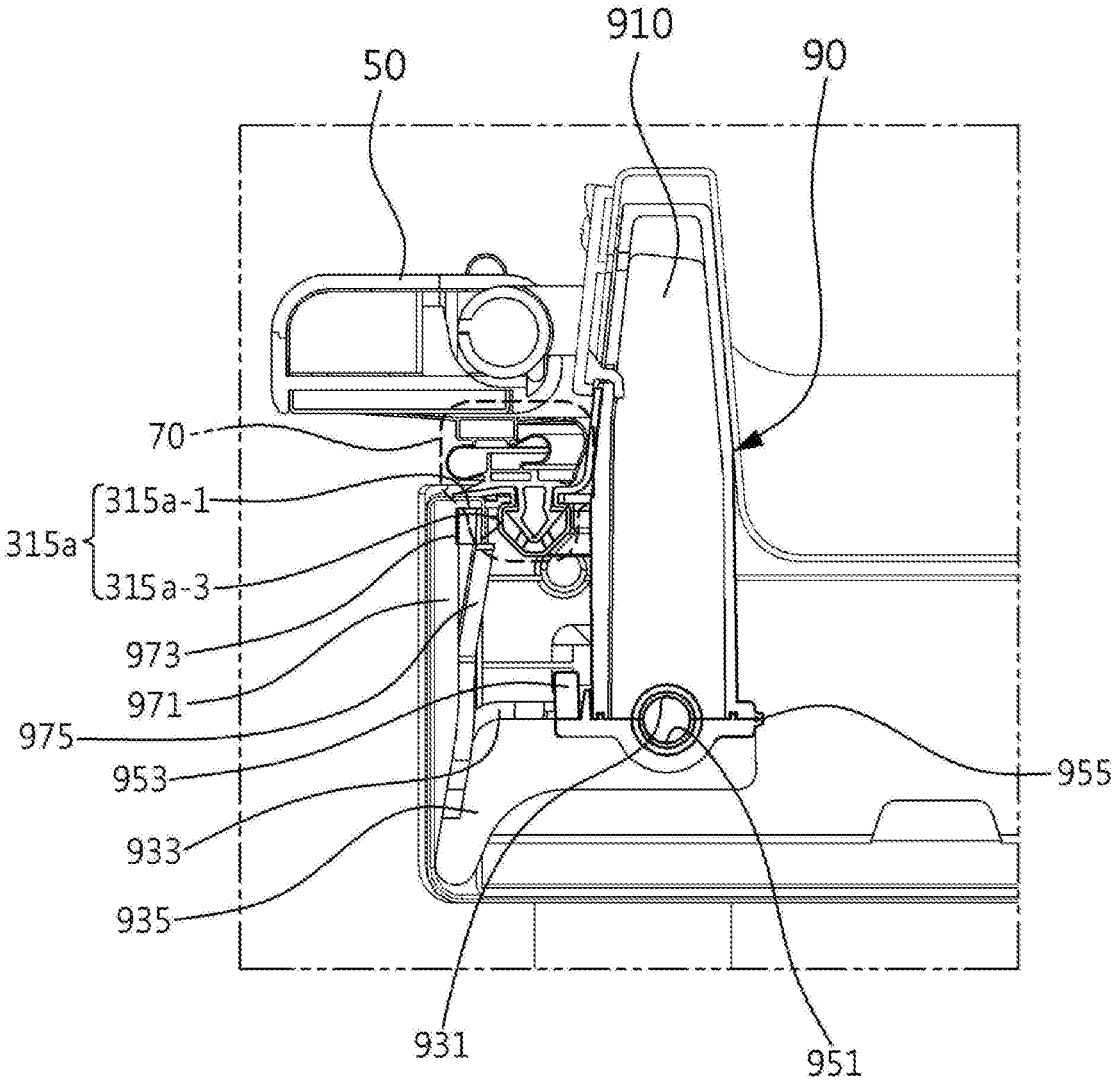
FIGS. 4 and 5 are cross sectional views illustrating configurations in which a fixing device is coupled with a bending part in accordance with an embodiment of the present invention.
Figure 5:
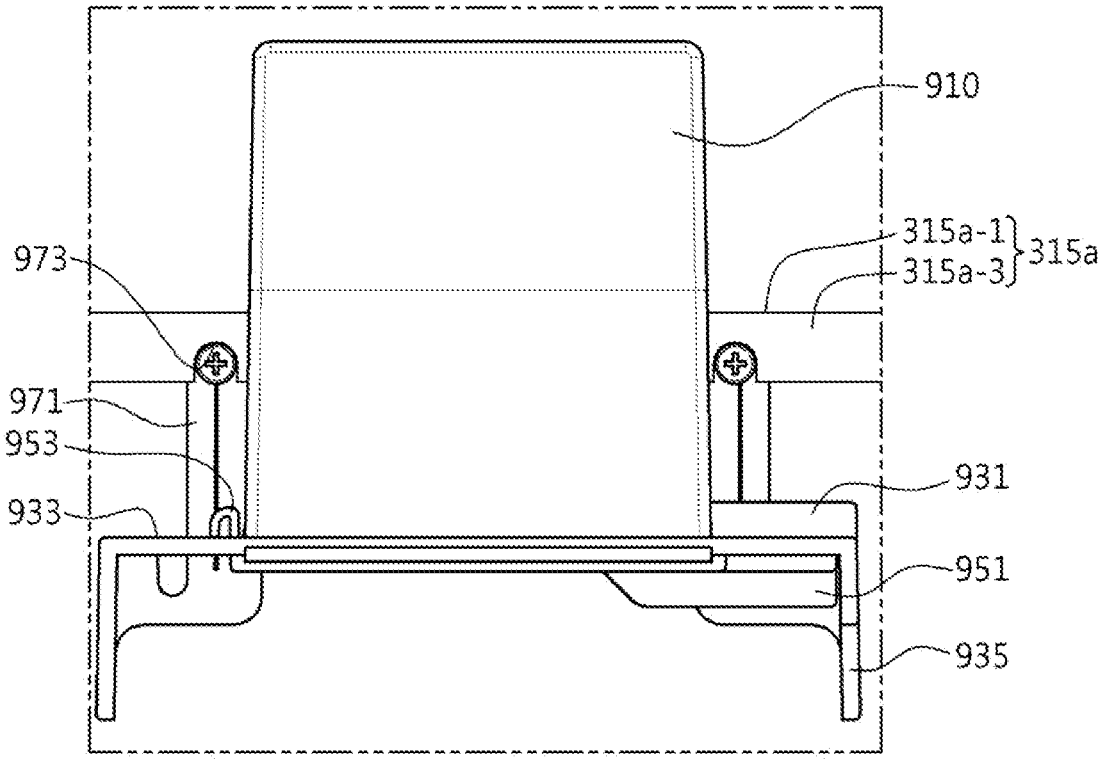
Figure 6:
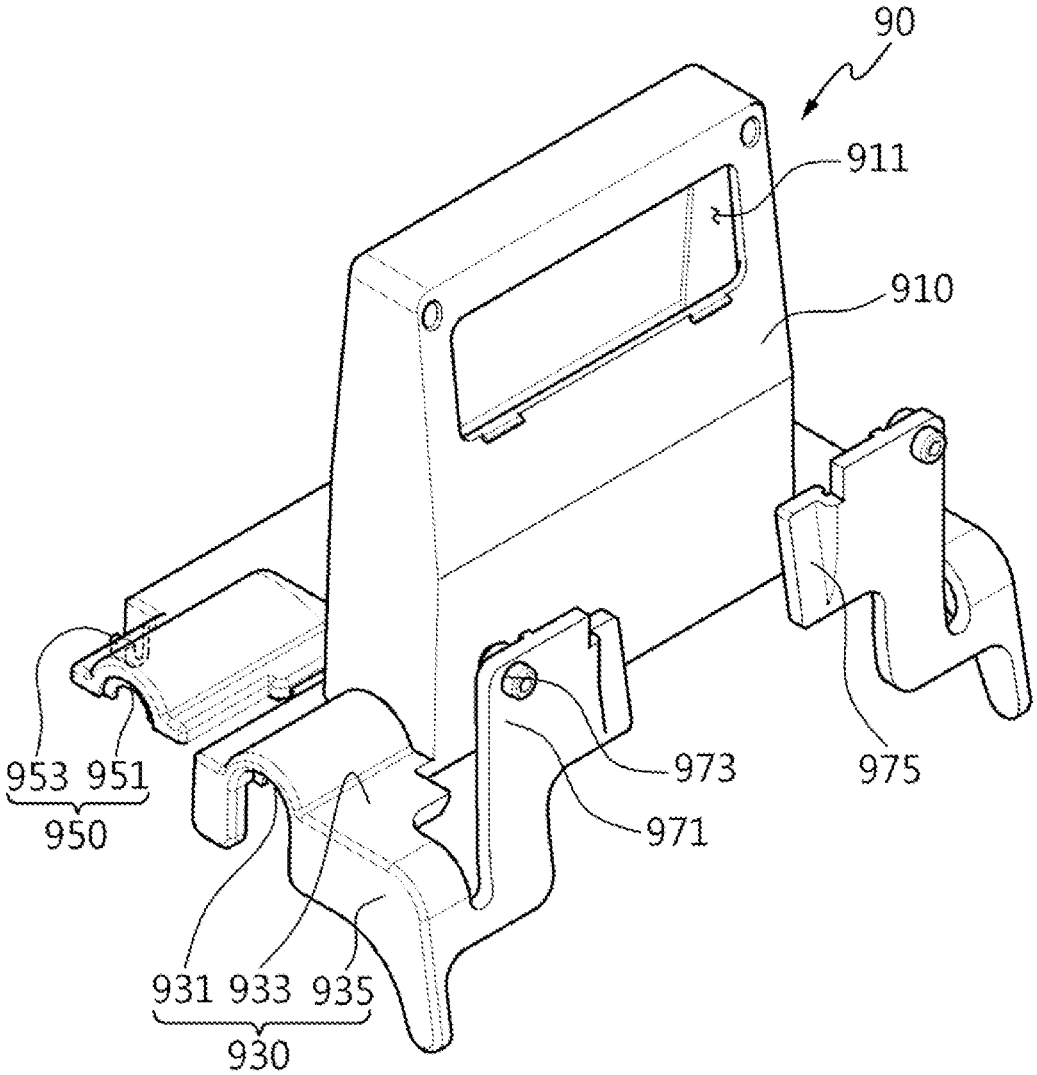
FIG. 6 is a perspective view of a wire harness fixing device according to an embodiment of the present invention.
Figure 7:
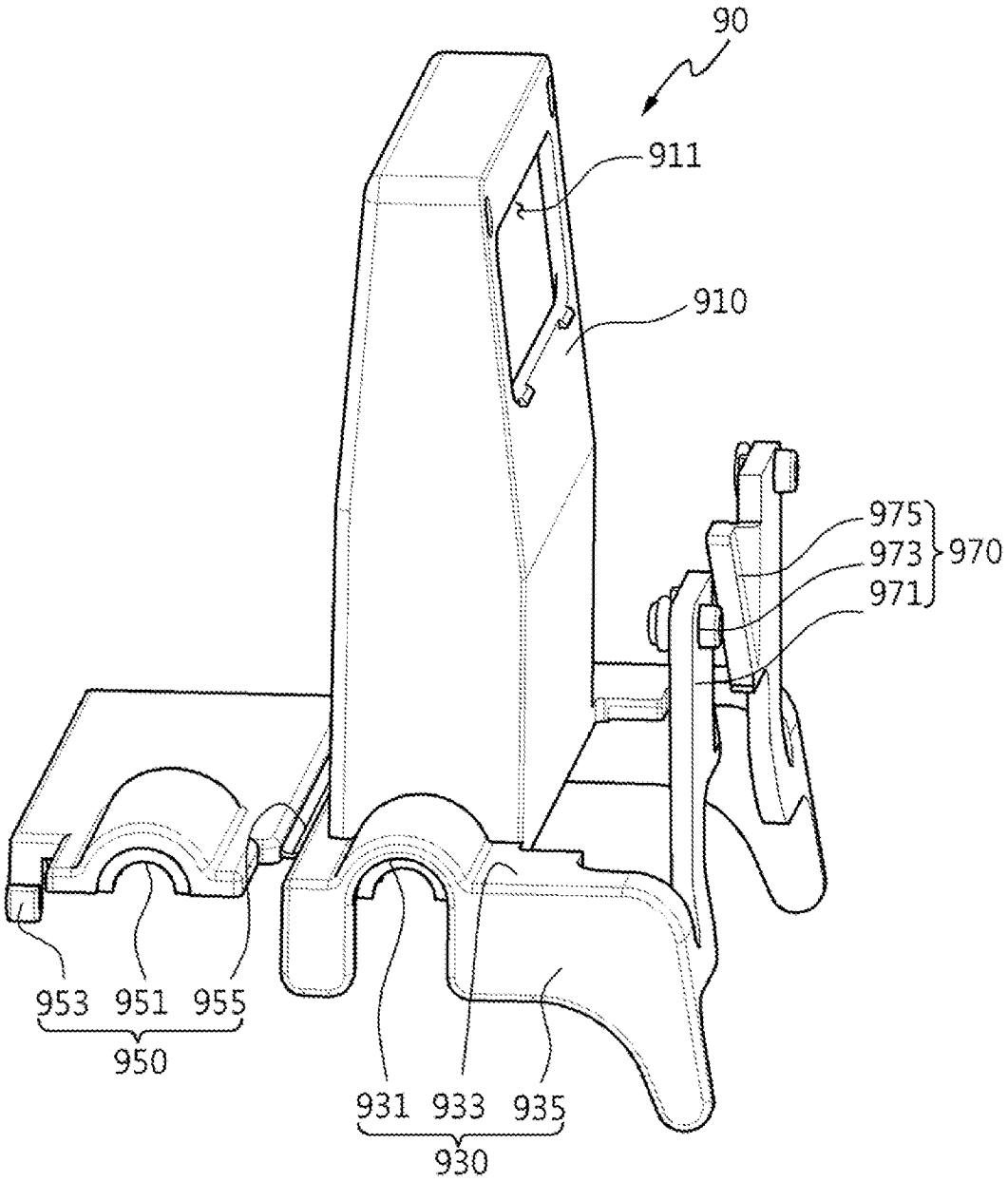
FIG. 7 is a side view of a fixing device according to FIG. 6.

FIG. 1 is a perspective view of a refrigerator including a wire harness fixing device according to an embodiment of the present invention; FIGS. 2 and 3 are cross sectional views illustrating the wire harness fixing device being coupled with an opening and closing unit (e.g., door) at one side of a refrigerator; FIGS. 4 and 5 are cross sectional views illustrating a state where a fixing device is coupled with a bending part; FIG. 6 is a perspective view of a wire harness fixing device according to an embodiment of the present invention; and FIG. 7 is a side view of a fixing device according to FIG. 6.

Hereinafter, a refrigerator appliance including a wire harness fixing device according to an embodiment of the present invention will be described in detail.

With reference to FIG. 1, the refrigerator appliance 1 according to an embodiment of the present invention includes: a main body unit 10 provided with a storage chamber formed therein and having a front surface thereof being open; and an opening and closing unit 30 (e.g., door) for opening and closing the front surface of the main body unit 10 in accordance with a rotational movement thereof about a hinge.

In addition, the main body unit 10 is preferably provided with a partition wall (not shown) that extends along a center of the storage chamber in a vertical direction, thereby dividing the storage chamber into left and right compartments, e.g., a freezer compartment and a refrigerator compartment, for instance. In addition, the door 30 has a left door 310 and a right door 330, e.g., one opening and closing unit for each of left and right sides thereof. Here, the left door 310 and the right door 310 are rotatable with a left side and a right side, respectively, of the front surface of the main body unit 10, as a corresponding center. For example, each of the left and right doors 310 and 330 may be hinged to the main body unit 10.

In the case of such a French door style refrigerator, there is a potential for cool air to leak along a space defined between the left door 310 and the right door 330. Accordingly, the refrigerator 1 according to an embodiment of the present invention further includes a partition unit 50 capable of sealing the space between the left and right doors 310 and 330.

With reference to FIGS. 1 to 3, the partition unit 50 is coupled with one door of the left and right doors 310 and 330, thereby enabling the space between both doors 310 and 330 to be sealed when both of the doors 310 and 330 are fully closed. In addition, when a door 310 or 330 (to which the partition unit 50 is coupled) is pivoted by a user pull thereof, the partition unit 50 pivots in a direction opposite to the rotating direction of the pivotal movement of door 310 or 330, thereby allowing the pivotal movement part of 310 or 330 easily open without interference of the other door that remains closed 310 or 330. That is, the partition unit 50 is rotatably coupled with any one of the doors 310 and 330.

In addition, an individual sealing portion 70 is disposed on a side of an inner panel 311 in a space between the partition unit 50, and the left and right doors 310 and 330 for each of the doors 310 and 330, in order to more reliably prevent cold air leakage.

Hereinafter, for ease of discussion, the door to which the partition unit 50 is coupled will be described as the left door 310 or the door located at one side 310, and the remaining door will be described as the right door 330 or the door located at the opposite side 330. However, the partition unit 50 and/or the fixing device 90, to be described later, may be coupled with any one of the left or right doors 310 and 330, in accordance with embodiments of the present invention, and there is no specific limitation thereto.

In addition, condensation may result on an outer surface of the partition unit 50 due to temperature differences between the inside and the outside of the storage chamber of the refrigerator. In order to prevent this, a heater (not shown) is disposed inside the partition unit 50, and a wire harness is connected from outside of the refrigerator 1 to the partition unit 50 for power supply and control.

The wire harness is disposed along an inner space of the door at one side 310 extending from the outside of the refrigerator 1 and comes out to a side adjacent to the partition unit 50 to reach the partition unit 50. The inner space of the door at one side 310 is an interspace defined by the inner panel 311 forming an inner wall of the storage chamber and an outer panel 313 forming an outer surface of the main body unit (See FIG. 2).

During manufacturing, an empty space between the inner panel 311 and the outer panel 313 is filled with an insulating foam material, such as urethane for instance, and the wire harness fixing device 90 is additionally provided to protect the wire harness from the insulating foam material and to also affix the wire harness.

With reference to FIGS. 3 to 5, the door at one side 310 is formed with a bending part 315*a* defining an end of the inner side wall 315 to which the inner and outer edges 311 and 313 are connected to bend.

More preferably, the bending part 315*a* is formed so that the side of the inner side wall 315 adjacent to the partition unit 50 is bent. In addition, the bending part 315*a* includes a first bent portion 315*a*-1 bent in a direction away from the door at opposite side 330 from the end of the inner side wall 315; and a second bent portion 315*a*-3 bent from an end of the first bent portion 315*a*-3 towards the outer panel 313. That is, the bending part 315*a* is generally formed in a "U-shaped cross section" overall. In addition, a first locking hole is formed on a side of the second bent portion 315*a*-3.

Hereinafter, the fixing device 90 according to an embodiment of the present invention will be described in detail with reference to the accompanying drawings.

With reference to FIGS. 3 to 7, as described above, the wire harness fixing device 90 protects the wire harness from the insulating foam material filled between the inner and outer panels 311 and 313, and affixes the wire harness at the same time. Here, the wire harness fixing device 90 may include: a body part 910; a fixing part 930; a cover part 950; and a coupling part 970, for these purposes.

With reference to FIGS. 6 and 7, the body part 910 is configured to have a hollow portion therein to allow a wire harness to be inserted into an internal space thereof, and an opening portion 911 formed to be partially open at one surface thereof, thereby allowing an end of the wire harness (inserted inwards) to be pulled out from the fixing device 90, and thus to be electrically connected to the heater unit inside the partition unit 50. The body part 910 is preferably formed in a hexahedral shape and having a substantially or entirely open bottom surface and is inserted in a recessed space of a shape, defined by the inner panel 311 and/or the sealing portion 70, and complementary to the body part 910.

Further, it is more preferable that the body part 910 be inclined such that the distance between opposite spaced sides thereof reduces or tapers in an upward direction, and thus the body part 910 is easily and intuitively inserted into the recessed space. Here, "sides" refer to one surface on which the opening portion 911 is formed and another surface facing the one surface.

The fixing part 930 is connected to a lower portion of the body part 910 and is preferably formed integrally with the body part 910 to guide the insertion of the wire harness to the fixing device 90. To this end, the fixing part 930 may include: a first guide groove 931; an upper plate 933; and a protection plate 935.

A first guide groove 931 is configured to be recessed upwardly at a predetermined depth on a side coupled with the front surface of the body part 910 and forms (together with a second guide groove 951, to be described later) a guide hole in a substantially cylindrical manner, thereby allowing the inserted wire harness to be rigidly affixed. For example, the recession curvature of the first guide groove 931 may be of a constant shape, but is not limited thereto. In addition, it is preferable that the first guide groove 931 is formed only on a side coupled with the front surface side of the body part 910 of the fixing device 90 since the wire harness is not drawn out to, nor introduced from, the rear side of the body part 910.

The upper plate 933 is formed extending from the end of the first guide groove 931 by a predetermined length in opposite lateral directions. By the upper plate 933, it is possible to substantially prevent the insulating foam material from filling into the fixing device 90. For example, the upper plate 933 may extend approximately horizontally.

The protection plate 935 extends from the end of the fixing part 930 downwards to a predetermined depth to prevent the insulating foam material from filling into the fixing device 90. In addition, it is preferable that the lower side of the first guide groove 931 is not formed with the protection plate 935, and thus is open, in order to allow the wire harness to be easily inserted there into. In addition, as will be described in detail below, when the fixing device 90 is affixed, it is preferable that the protection plate 935 is of a length such that the lowermost end of the protection plate 935 does not contact the inner surface of the door at one side 310. More specifically, it is preferable that the protection plate 935 does not contact the inner surface of the outer panel 313. Accordingly, it is possible to prevent the outer surface of the outer panel 313 from curving over time. Accordingly, there is no need for application of any relatively high-priced nonwoven fabric disposed between the fixing device and the outer panel 313 in order to prevent the formation of such curvature. This advantageously makes maintenance of the refrigerator easier as well as reduces the overall costs associated with the appliance.

The cover part 950 is configured to be coupled with a lower end portion of one side of the body part 910, thereby allowing an open lower end portion of the fixing device 90 to be opened or closed. Meanwhile, the shape of the cover part 950 may be formed as a flat surface. In addition, it is preferable that the cover part 950 closes the fixing device 90 by a rotation movement to the lower end side of the fixing device 90. To this end, the cover part 950 may include: a second guide groove 951; a coupling portion 953; and a connection portion 955.

The second guide groove 951 is recessed upwardly when the cover part 950 is fully opened and is recessed downwardly when the cover part 950 is fully closed, at a predetermined depth, to form a cylindrical guide hole together with the first guide groove 931. It is preferable that the second guide groove 951 be formed such that it has a substantially semicircular groove similar to the first guide groove 931. In addition, a radius of the second guide groove 951 is preferably smaller than a radius of the first guide groove 931, thereby allowing the wire harness to be more rigidly affixed when the lower end portion of the fixing device 90 is closed by the cover part 950.

It is appreciated that, the wire harness will easily insert into the first guide groove 931 because of its relatively large radial size, and then the second guide groove 951 having a small radial size affixes the wire harness more tightly.

The radius of the second guide groove 951 may be larger than or equal to the radius of the first guide groove 931, but is not specifically limited thereto.

The coupling portion 953 is formed at each of spaced opposite ends of the cover part 950, thereby being coupled with one side of the fixing part 930 to allow the cover part 950 to close the lower end portion of the fixing device 90. For example, the coupling portion 953 is formed in a shape of a hook, and when the lower end portion of the fixing device 90 is closed (due to a rotation movement of the cover part 950) the coupling portion 953 may be coupled with, and affixed to, an upper surface of the upper plate 933. However, it is appreciated that the scope of the present invention is not limited by the above example.

The connection portion 955 is a groove formed along the longitudinal direction of a side of the cover part 950, the side coupled with the body part 910, thereby allowing the cover part 950 to rotate to cover the lower end side of the body part 910. Accordingly, the connection portion 955 has a thinner thickness than other components of the cover part 950. Meanwhile, once the cover 950 covers the lower end side of the body 910, the cover part 950 is fixed by the insulating foam material being subsequently filled. In this regard, it is unlikely that connection portion 955 will break due to repeated opening and closing of the cover part 950.

The coupling part 970 is configured to fix the fixing device 90 to the door located at one side 310. To this end, the coupling part 970 may include: an insertion portion 971; a second locking hole 973; and a positioning portion 975.

The insertion portion 971 is configured to extend upwardly and the upper portion thereof is inserted into an inner space defined by the bending part 315*a* More specifically, the upper side of the insertion portion 971 is inserted inside the first bent portion 315*a*-1 and the second bent portion 315*a*-3. In addition, the first bent portion 315*a*-1 contacts the upper end of the insertion portion 971, thereby performing a stopper function.

The second locking hole 973 is formed through the upper side of the insertion portion and allows a locking means to be inserted therein when aligned with the first locking hole, thereby fixing the fixing device 90 rigidly. Here, the locking means may be any of various well known components, and, for example, may be a plain screw.

In addition, the distance from the height of the second locking hole 973 to the lowermost end of the fixing device 90 is shorter than the distance from the first locking hole to an inner surface of the of an outer panel 313 facing the inner panel of the door at one side 310 (See FIG. 3.). Accordingly, in this configuration, embodiments of the present invention advantageously prevent curvature from resulting on the side of the outer panel 313.

The positioning portion 975 extends upwardly on a side adjacent to the insertion portion 971 at an acute angle with the insertion portion 971, and has an upper surface in a shape complementary to the lower surface of the second bent portion 315*a*-3. That is, when the upper side of the insertion portion 971 is inserted into the bending part 315*a*, thereby aligning the first and second locking holes 971 and 973 with each other, the upper surface of the positioning portion 975 contacts the second bent portion 315*a*-3, thereby preventing the fixing device 90 from shaking when the locking means is inserted inside the locking holes 971 and 973.

While the present invention has been described in connection with what is presently considered to be practical exemplary embodiments, it is to be appreciated that various modifications, additions and substitutions are possible. It will be understood by those skilled in the art that various changes and modifications may be made without departing from the scope of the present invention.

What is claimed is:

1. A wire harness fixing device for a refrigerator appliance, the fixing device comprising:

a body part configured with a hollow portion formed therein, wherein the hollow portion is operable to allow a wire harness to be inserted therein, and wherein the body part is further configured with an opening portion being partially open at one surface thereof;

a fixing part coupled to a lower portion of the body part and operable to guide insertion of the wire harness;

a cover part coupled with a lower end surface of one side of the body part, and operable to allow an open lower portion of a fixing device to be selectively opened or closed; and a coupling part configured to affix the fixing device to one side of the refrigerator appliance.

2. The device of claim 1, wherein the fixing part comprises:

a first guide groove recessed upwardly at a side coupled with a front surface of the body part, and configured to guide insertion of the wire harness;

an upper plate extending in opposite lateral directions from an end of the first guide groove; and a protection plate extending downward from an end of the upper plate, and operable to prevent a foam material from filling into the fixing device.

3. The device of claim 2, wherein the cover part comprises:

a second guide groove recessed upwardly relative to the cover part being fully opened, and forming a cylindrical guide hole together with the first guide groove;

a coupling portion disposed at each of spaced opposite ends of the cover part, and configured to maintain the cover part closed by being coupled with one side of the fixing part; and a connection part disposed in a groove along a longitudinal direction of a side of the cover part, wherein the side being coupled with the body part, and operable to enable the cover part to rotate.

4. The device of claim 3, wherein the coupling portion has an overall shape of a hook.

5. The device of claim 3, wherein the second guide groove has a radius smaller than a radius of the first guide groove.

6. A refrigerator comprising:

a wire harness fixing device comprising:

a body part configured with a hollow portion formed therein, wherein the hollow portion is operable to allow a wire harness to be inserted therein, and wherein the body part is further configured with an opening portion being partially open at one surface thereof;

a fixing part coupled to a lower portion of the body part and operable to guide insertion of the wire harness;

a cover part coupled with a lower end surface of one side of the body part, and operable to allow an open lower portion of a fixing device to be selectively opened or closed; and a coupling part configured to affix the fixing device to one side of the refrigerator appliance;

a main body unit comprising a storage chamber and having a front surface thereof being open;

a pair of left and right opening and closing units operable for selectively opening and closing the front surface of the main body unit in accordance with a rotation movement thereof; and a partition unit rotatably coupled with one opening and closing unit at one side to prevent cold air from leaking along a space defined between the left and right opening and closing units.

7. The refrigerator of claim 6, wherein the opening and closing unit at the one side comprises a bending part forming an end of an inner side wall to which inner and outer panels are connected to bend, wherein the bending part comprises:

a first bent portion where a side is bent adjacent to the partition unit of the inner side wall; and a second bent portion bent towards an outer panel side from an end of the first bent portion and having a first locking hole, and being formed in a U-shaped cross section.

8. The refrigerator of claim 7, wherein the coupling part comprises:

an insertion portion extending upwardly and having an upper portion inserted into an inner space of the bending part; and a second locking hole formed through an upper side of the insertion portion and allowing a locking means to be inserted therein when aligned with the first locking hole.

9. The refrigerator of claim 8, wherein a distance from a height of the second locking hole to a lowermost end of the fixing device is shorter than a distance from the first locking hole to an inner surface of an outer panel facing an inner panel of the opening and closing unit at the one side.

10. The refrigerator of claim 8, wherein the coupling part further includes a positioning portion extending upwardly on a side adjacent to the insertion portion at an acute angle relative to the insertion portion.

11. The refrigerator of claim 10, wherein the positioning portion has an upper surface shaped complementary to a lower surface of the second bent portion, and operable to prevent the wire harness fixing device from shaking by allowing the upper surface of the positioning portion to contact the lower surface of the second bent portion when the first and second locking holes are aligned.

12. The refrigerator of claim 7, wherein the body part has a hexahedral shape with a bottom surface being partially or wholly open, and is further inclined wherein a distance between opposite spaced sides of the body part taper in an upward direction.

13. The refrigerator of claim 7, wherein the fixing part comprises:

a first guide groove recessed upwardly at a side coupled with a front surface of the body part, and configured to guide insertion of the wire harness;

an upper plate extending in opposite lateral directions from an end of the first guide groove; and a protection plate extending downward from an end of the upper plate, and operable to prevent a foam material from filling into the fixing device.

14. The refrigerator of claim 13, wherein the cover part comprises:

a second guide groove recessed upwardly relative to the cover part being fully opened, and forming cylindrical guide hole together with the first guide groove;

a coupling portion disposed at each of spaced opposite ends of the cover part, and configured to maintain the cover part closed by being coupled with one side of the fixing part; and a connection part disposed in a groove along a longitudinal direction of a side of the cover part, wherein the side being coupled with the body part, and operable to enable the cover part to rotate.

15. The refrigerator of claim 14, wherein the coupling portion has an overall shape of a hook.

16. The refrigerator of claim 14, wherein the second guide groove has a radius smaller than a radius of the first guide groove.

* * * * *